US006381135B1

(12) United States Patent
Prasher et al.

(10) Patent No.: US 6,381,135 B1
(45) Date of Patent: Apr. 30, 2002

(54) LOOP HEAT PIPE FOR MOBILE COMPUTERS

(75) Inventors: Ravi Prasher; Dave Payne, both of Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/814,078

(22) Filed: Mar. 20, 2001

(51) Int. Cl.[7] ..... H05K 7/20

(52) U.S. Cl. ..... 361/700; 361/698; 361/699; 174/15.2; 257/714; 257/715; 165/80.4; 165/104.26

(58) Field of Search ..... 361/698, 700; 257/714, 715; 174/15.1, 15.2; 165/80.4, 104.26

(56) References Cited

U.S. PATENT DOCUMENTS 4,765,396 A * 8/1988 Seidenberg ..... 165/104.26
4,883,116 A * 11/1989 Seidenberg et al. .... 165/104.26
4,921,041 A * 5/1990 Akachi ..... 165/104.29
5,761,037 A * 6/1998 Anderson et al. ..... 361/700
6,082,443 A * 7/2000 Yamamoto et al. .... 165/104.26
6,227,288 B1 * 5/2001 Gluck et al. ..... 165/104.26
6,269,865 B1 * 8/2001 Huang ..... 165/104.26

FOREIGN PATENT DOCUMENTS

JP 355092884 A * 7/1980 ..... 165/104.21
JP 359084084 A * 5/1984 ..... 165/104.26

* cited by examiner

*Primary Examiner*—Leo P. Picard
*Assistant Examiner*—Boris L. Chervinsky
(74) *Attorney, Agent, or Firm*—Blakely, Sokoloff, Taylor & Zafman LLP

(57) ABSTRACT

A heat transfer device for a mobile computer system using a loop heat pipe, the evaporator of the loop heat pipe coupled to the processor die. The vapor space and liquid space are separated. The separation of the vapor space, and the wick structure of the liquid space, ensures that the vapor space will not be distorted or clogged by the wick structure. The heat transfer device can be bent to meet design criteria without distorting the width or radius of the vapor space. In one embodiment of the present invention the evaporator, condenser, and liquid space have different types of wick structure. Another embodiment of the present invention, the vapor space of the loop heat pipe has uniform thickness. The loop heat pipe device of the present invention provides reduced evaporator and condenser resistance and increased burn out flux, thereby increasing the power handling capacity of the device.

19 Claims, 3 Drawing Sheets

3C

3B

3A

LOOP HEAT PIPE FOR MOBILE COMPUTERS

FIELD OF THE INVENTION

This invention relates generally to heat removal in computer systems, and more specifically, to an improved heat removal device for mobile computing systems.

BACKGROUND OF THE INVENTION

As mobile computing systems (e.g., laptops) become smaller and smaller, the need for design flexibility increases. The power level of laptop processors is increasing with a corresponding increase in heat that must be removed from the system.

FIGS. 1A and 1B show a front view and a side view, respectively, of a typical heat transfer system used in mobile computing applications. The heat transfer system 100A shown in FIG. 1A, includes a substrate 102A with a die 104A sitting on top of the substrate 102A. Die 104A is typically made of silicon and contains the electronic components of the microprocessor. Heat is generated in die 104A and passed through thermal interface material (TIM) 106A to a heat spreader 108A. Heat spreader 108A is typically larger than the die 104A. The TIM 106A reduces the contact resistance between the die 104A and the heat spreader 108A. The Tim 106A may be solder, a particle-laden polymer, or other material exhibiting similar thermal properties. Heat spreader 108A is typically a copper block and is soldered to heat pipe 112A with a solder layer 110A. Embedded in heat pipe 112A is a wick structure 114A and a vapor space 116A that contains vapor. The walls of the heat pipe are typically copper. The heat generated in the die 104A is used to heat the liquid in the vapor space to convert it to a vapor. The vapor then condenses when heat is drawn through the heat sink 118B depicted in FIG. 1B. The heat sink 118B is typically a copper or aluminum block that may have fins to dissipate the heat more quickly. The wick structure 114A works as a capillary pump that brings the condensed liquid back to the heating region thereby maintaining a continuous loop.

This cooling method is known as remote cooling because the heat is not ejected at the location of the die, but is transferred elsewhere and ejected. In a typical desktop computer the heat sink can be placed directly on top of the die, but for mobile applications a thinner implementation is desired. Another reason remote cooling is desired in mobile applications is that it allows for the heat sink to be located next to an exhaust fan typically located in a corner of the laptop. This allows the heat to be carried out of the mobile system quickly.

The prior art heat transfer system presents several problems concerning wick structure 114A. The first is due to the fabrication process used to create the wick structure 114A. Typically a wick structure is made of porous copper. The wick structure is fabricated by sprinkling powdered copper along the inner length of the heat pipe. The powdered copper is then heated and slightly melted. This forms a porous copper structure. This process is not exact, and the wick structure 114A typically has large variations in its thickness along the length of the heat pipe. Because the vapor space 116A is a space above the wick structure 114A, variations in the thickness of the wick structure 114A cause corresponding variations in the thickness of the vapor space.

The thermal resistance is inversely proportional to the $4^{th}$ power of the vapor space thickness or radius. Therefore small variations in the thickness of the vapor space 116 cause large variations in the thermal resistance.

Another problem with the prior art heat transfer system 100A is in the component layout. Typically the fan is located in the corner and the processor is located somewhere else. Since it is desirable to have the heat sink next to the fan, the heat pipe may have to be twisted and bent to accommodate component layout. This twisting and bending can also lead to variations in the thickness of the wick structure and therefore variations in the vapor space.

Another drawback is that the current fabrication process provides one wick structure for all areas of the heat transfer process. Ideally, to enhance the performance of a heat pipe, it is desired to have wick structure with variable porosity so that the evaporative and the condenser section have highly porous wick structures to enhance the boiling and condensation heat transfer and the adiabatic section has a different wick structure for optimized pressure drop. The current manufacturing technology of heat pipes does not allow this.

Another problem with the heat pipe technology is that if the manufacturing process is not very controlled, there could be clogging of the vapor space due to variations in wick thickness. This will lead to a very poor thermal performance of the heat pipe.

Performance of current heat pipe technology also suffers from the variation in the weight of wick and in water charge level.

BRIEF DESCRIPTION OF THE DRAWINGS

The present invention is illustrated by way of example and not intended to be limited by the figures of the accompanying drawings in which like references indicate similar elements and in which.

DETAILED DESCRIPTION

According to one aspect of the present invention, a heat transfer device for a mobile computer system is provided. A loop heat pipe is used, with the evaporator of the loop heat pipe coupled to the processor die. The vapor space and liquid space are separated. This allows the vapor to reach the condenser though the vapor space and the liquid to return to the evaporator through the wick structure of the liquid space, with no interaction between the liquid and the vapor in the adiabatic section. The separation of the vapor space, and the wick structure of the liquid space, ensures that the vapor space will not be distorted or clogged by the wick structure. This provides greater layout flexibility as the heat transfer device can be bent to meet design criteria without distorting the width or radius of the vapor space. According to one embodiment of the present invention the evaporator, condenser, and liquid space have different types of wick structure. In one embodiment of the present invention a loop heat pipe device for a mobile computer system, is provided, having a vapor space of uniform thickness. Another embodiment of the present invention provides a loop heat pipe device having an evaporator attached to the die with no solder layer. This is very beneficial as solder is a high thermal resistance material. The loop heat pipe device of the present invention provides reduced evaporator and condenser resistance and increased burn out flux, thereby increasing the power handling capacity of the device.

Figure 1A:
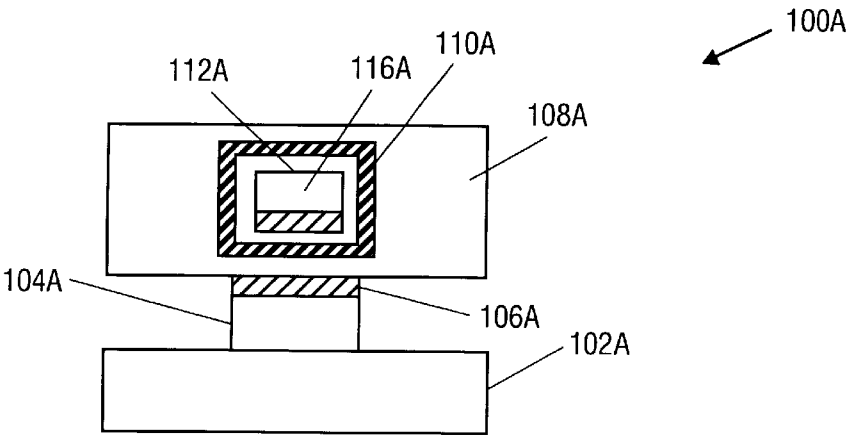
FIG. 1A (PRIOR ART)
FIG. 1 shows a typical heat transfer system used in mobile computing applications according to the prior art.
Figure 1B:
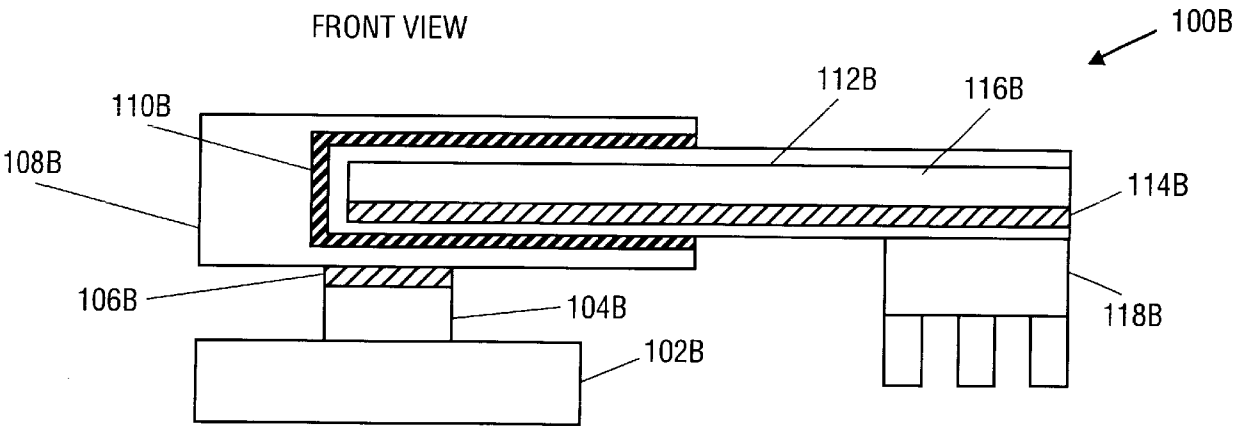
FIG. 1B (PRIOR ART)
Figure 2:
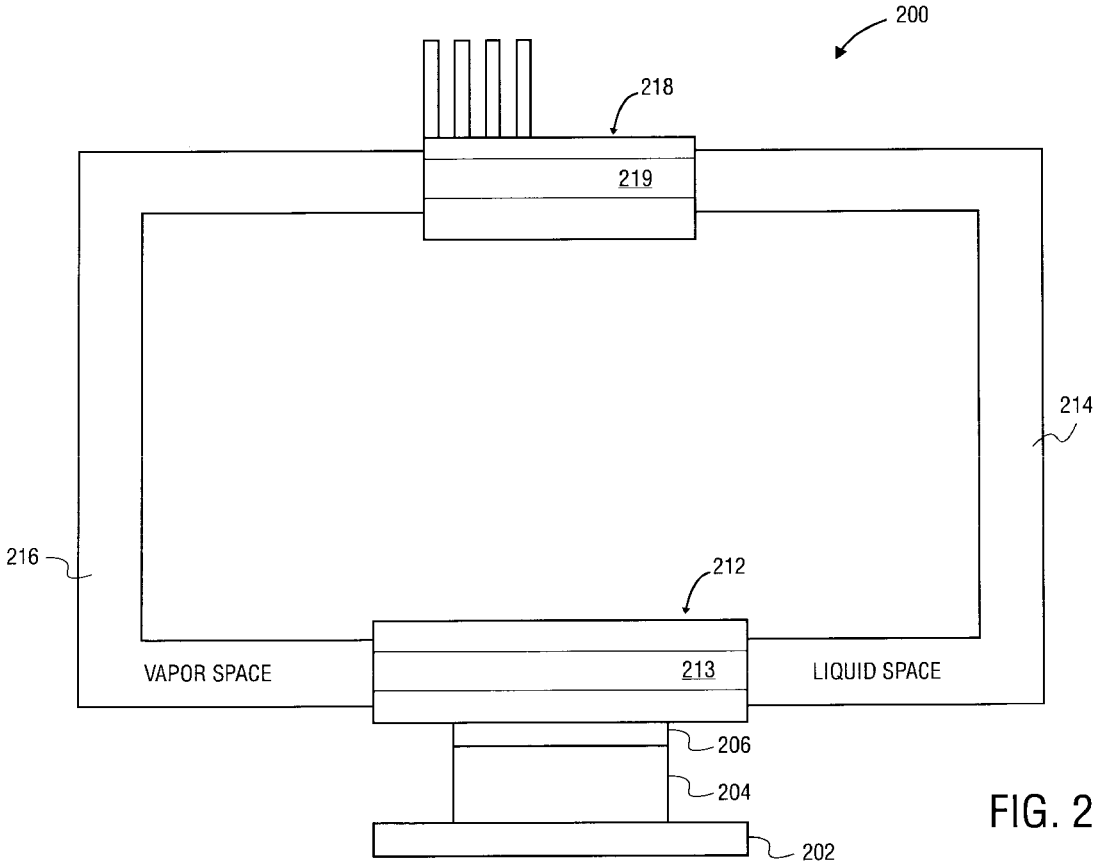
FIG. 2 shows a loop heat pipe for mobile computing systems according to the present invention.
Figure 3:
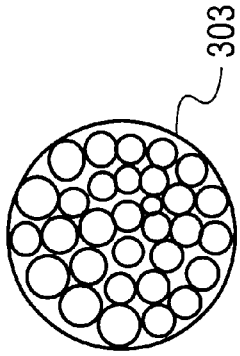
FIG. 3 shows three exemplary wick structures, 3*a*, 3*b*, and 3*c*, for use with the present invention.
Figure 3:
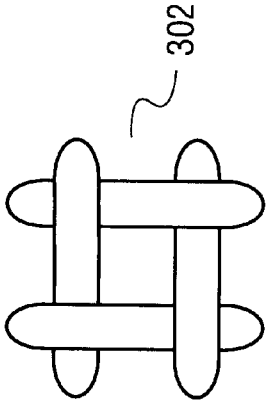
Figure 3:
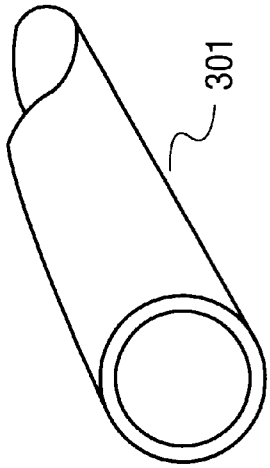

FIG. 2 shows a loop heat pipe for mobile computing systems according to the present invention. The loop heat pipe 200 shown in FIG. 2 has a substrate 202 with a die 204 on top of the substrate 202. TIM layer 206 is between the die and the evaporator 212. The absence of the solder layer of the prior art is very beneficial as solder is a high thermal resistance material. The evaporator 212 is a hollow copper block that also acts as a heat spreader. The evaporator 212 is placed on the die with only the TIM layer 206 between them. The evaporator contains a wick structure 213 that adjoins the liquid space 214 on one side. Liquid space 214 also contains a wick structure, however the wick structure of the liquid space 214 and wick structure 213 of the evaporator need not be the same type of wick structure. The different wick structures could be fabricated using the powdered copper method as discussed above only with a different porosity, or could be wick structures fabricated in some other way (e.g., wire mesh wick). FIG. 3, as described below, shows various wick structures that may be used in accordance with the present invention. The ability to implement different wick structures at different areas of the heat pipe is beneficial as it is desirable that the evaporator wick structure has low thermal resistance. Thermal resistance is not as important a consideration for the liquid space wick structure. What is important to consider for the liquid space wick structure is the pumping capacity (i.e., heat carrying capacity). The pumping capacity affects the maximum power handling capacity of the heat pipe. The ability to use two different types of wick structure at different places in the heat pipe enhances the design flexibility and overall performance characteristics of the heat pipe.

Adjoining the wick structure 213, on the other side, is vapor space 216. The vapor space 216 is no longer in direct contact with the wick structure of the liquid space. Variations of the wick structure thickness no longer affect the vapor space. Vapor space 216 is simply a hollow tube. The thickness or radius of the vapor space can, therefore, be highly controlled and will be highly uniform. Having the vapor space separate from the liquid space wick structure produces a vapor space that is highly insensitive to manufacturing tolerances and variation in the amount of wick and water charge level.

The vapor reaches the condenser section 218 through the vapor space and liquid returns through the wick structure of the liquid space. There is no interaction between the liquid and the vapor in the adiabatic section. Condenser 218 is a hollow block of copper, or some thermally similar metal (e.g., aluminum). In one embodiment condenser 218 has fins attached to dissipate heat. In another embodiment fins may be placed along the vapor space wall. The condenser 218 has a wick structure 219 as well that may be different than the wick structure 213 or the wick structure of the liquid space. As discussed above, there may be design considerations that indicate one wick structure as opposed to another. For example, it is desirable to have an evaporator with a low thermal resistance wick, however in the condenser a wick with low thermal resistance may not be necessary. This is the case where the condenser is much larger than the evaporator. If the condenser is smaller than the evaporator, a condenser wick with low thermal resistance is called for.

As discussed above, an embodiment of the present invention may use wick structures of varying porosity or may use different wick structures. FIG. 3 shows three exemplary types of wick structure, 3*a*, 3*b*, and 3*c*, for use with the present invention, The wick structure 301 shown in FIG. 3*a* is a circular artery type wick structure for use, for example, in the evaporator 213. FIG. 3*b* shows a square wire mesh screen type wick structure 302 and FIG. 3*c* shows an unconsolidated packed spherical particle type wick structure 303. The square wire mesh screen type wick structure and the packed spherical particle type wick structure have higher pumping capacity and are better for use as wick structures for liquid space 214.

In one preferred embodiment, the condenser and the evaporator have highly porous wick structures. Having highly porous wick structures in the evaporator and the condenser can substantially reduce the evaporative and condenser thermal resistance, which is very desirable for high wattage applications. Also, having highly porous wick structures in the evaporator and the condenser provides higher burn out flux. For a non-uniformly heated die the flux could be very high. This will enable heat pipes to be used for high flux processors.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative sense rather than a restrictive sense.

What is claimed is:

1. A device comprising:

a die of a computer processor; and a loop heat pipe coupled to the die, the loop heat pipe having an evaporator coupled to the die; the evaporator having a first wick structure such that heat emanating from the die evaporates liquid in the first wick structure causing the die to cool;

a vapor space for transferring the vapor from the evaporator to a condenser, the condenser having a second wick structure; and a liquid space, having a third wick structure, for transferring liquid from the condenser to the evaporator.

2. The device of claim 1, wherein the vapor space is a copper tube of uniform cross-sectional area.

3. The device of claim 1, wherein the condenser has fins to dissipate heat.

4. The device of claim 3, wherein the vapor space has fins to dissipate heat.

5. The device of claim 1, wherein the first wick structure, the second wick structure and the third wick structure comprise porous copper.

6. The device of claim 5, wherein the first wick structure and the second wick structure have higher porosity than the third wick structure.

7. The device of claim 1, wherein the first wick structure and the second wick structure have lower thermal resistance than the third wick structure.

8. The device of claim 5, wherein the third wick structure has a higher pumping capacity than the first wick structure.

9. A method comprising:

coupling a die of a computer processor to a loop heat pipe such that heat is removed from the die and remotely ejected, the loop heat pipe having:

an evaporator coupled to the die; the evaporator having a first wick structure such that heat emanating from the die evaporates liquid in the first wick structure causing the die to cool;

a vapor space for transferring the vapor from the evaporator to a condenser, the condenser having a second wick structure; and a liquid space, having a third wick structure, for transferring liquid from the condenser to the evaporator.

10. The method of claim 9, wherein the vapor space is a copper tube of uniform cross-sectional area.

11. The method of claim 9, wherein the condenser has fins to dissipate heat.

12. The method of claim 11, wherein the vapor space has fins to dissipate heat.

13. The method of claim 9, wherein the first wick structure, the second wick structure and the third wick structure comprise porous copper.

14. The method of claim 13, wherein the first wick structure and the second wick structure have higher porosity than the third wick structure.

15. The method of claim 9, wherein the first wick structure and the second wick structure have lower thermal resistance than the third wick structure.

16. The method of claim 13, wherein the third wick structure has a higher pumping capacity than the first wick structure.

17. An apparatus comprising:

a heat loop pipe having an evaporator with a first wick structures, a liquid space with a second wick structure, and a condenser having a third wick structure.

18. The apparatus of claim 17, wherein the first wick structure and the second wick structure are comprised of porous copper, the first wick structure having different porosity than the second wick structure.

19. The apparatus of claim 17, wherein the first wick structure and the third wick structure are comprised of porous copper, the first wick structure having different porosity than the third wick structure, and the second wick structure is comprised of cooper mesh.

* * * * *